US005977473A

United States Patent [19]

Adinolfi

[11] Patent Number: 5,977,473

[45] Date of Patent: Nov. 2, 1999

[54] ACOUSTIC DRUM WITH SHELL WALL EMBEDDED ELECTRONIC TRIGGER SENSOR AND HEAD TO SHELL SOUND TRANSFER ARM

[76] Inventor: Alfonso M. Adinolfi, 607-18th Ave. East, Seattle, Wash. 98112

[21] Appl. No.: 09/141,629

[22] Filed: Aug. 28, 1998

Related U.S. Application Data

[63] Continuation-in-part of application No. 08/925,414, Sep. 8, 1997, Pat. No. 5,811,709.

[51] Int. Cl.[6] ..... G10D 13/02; G10H 3/00

[52] U.S. Cl. ..... 84/723; 84/725; 84/730; 84/104; 84/411 R; 84/DIG. 24

[58] Field of Search ..... 84/104, 411 R, 84/723–725, 730, DIG. 24

[56] References Cited

U.S. PATENT DOCUMENTS

| | | | |
|---|---|---|---|
| 3,725,561 | 4/1973 | Paul . | |
| 4,226,156 | 10/1980 | Hyakutake . | |
| 4,279,188 | 7/1981 | Scott | 84/1.14 |
| 4,581,973 | 4/1986 | Hoshino | 84/1.14 |
| 4,899,633 | 2/1990 | Lombardi | 84/730 |
| 4,947,725 | 8/1990 | Nomura | 84/723 |
| 4,984,498 | 1/1991 | Fishman | 84/730 |
| 5,042,356 | 8/1991 | Karch | 84/725 |
| 5,105,710 | 4/1992 | Rothmel | 84/730 |
| 5,293,000 | 3/1994 | Adinolfi | 84/730 |
| 5,811,709 | 9/1998 | Adinolfi | 84/723 |

*Primary Examiner*—William M. Shoop, Jr.
*Assistant Examiner*—Marlon T. Fletcher
*Attorney, Agent, or Firm*—Graybeal Jackson Haley LLP

[57] ABSTRACT

An acoustic drum capable of triggering an electronic sound source is provided by a combination of a drum body shell, conventional drum heads held at adjustable tension across open ends of the shell, and a sound-to-electrical transducer mounted within an open space of the interior or exterior shell wall surface. The sound-to-electrical transducer is connected to an audio jack assembly which in turn allows the drum to be connected to conventional downstream electronics. The sound energy attenuating characteristics of the mounting material and the surrounding shell wall prevent the transducer from being falsely triggered by ambient sound exterior to the drum, by sympathetic vibrations of the drum, and resists false triggering due to lightly, inadvertently hitting the drum stand. A sound energy transfer arm with elastomeric pad having limited contact with the striking head couples vibration to the embedded transducer in the shell wall for enhanced trigger sensitivity and tracking.

19 Claims, 5 Drawing Sheets

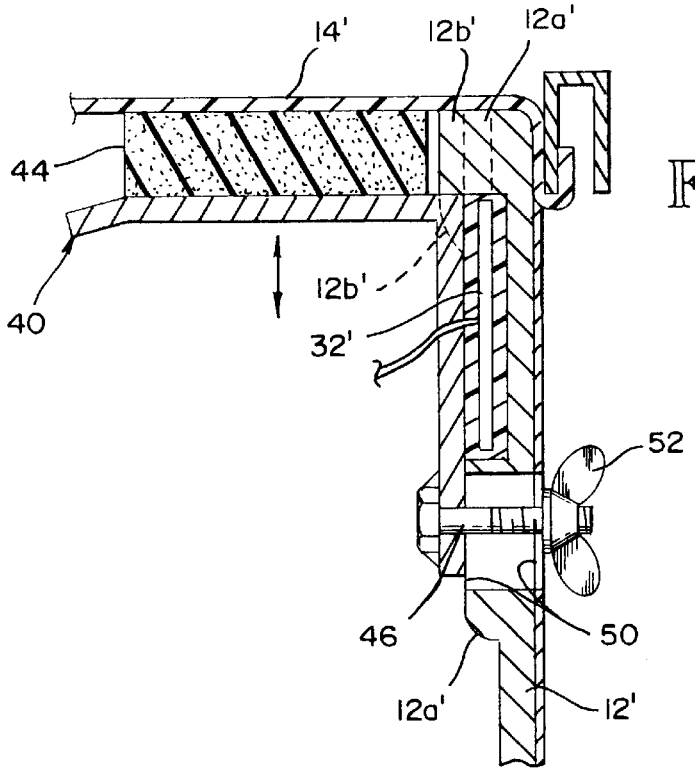
FIG. 7
FIG. 8
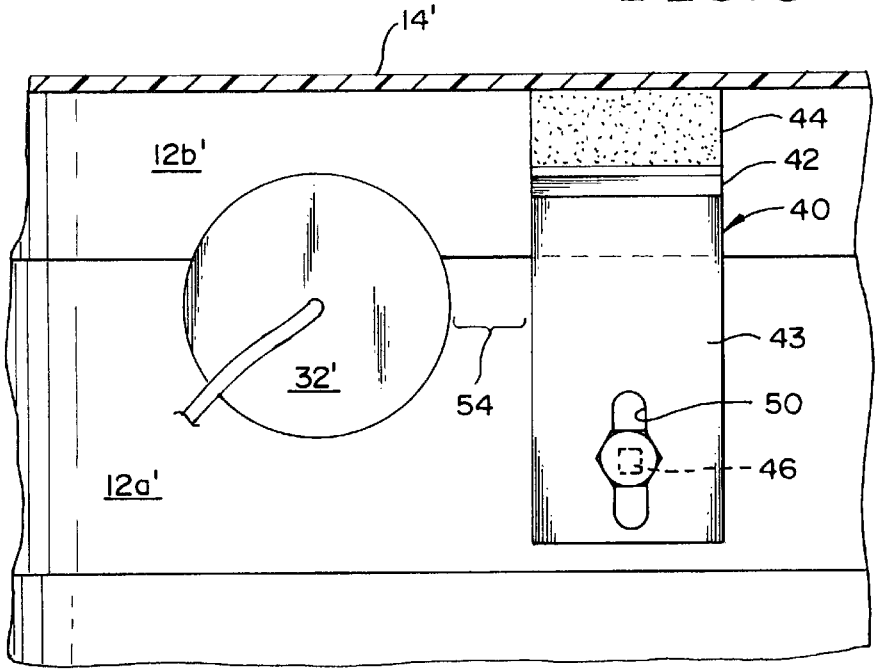

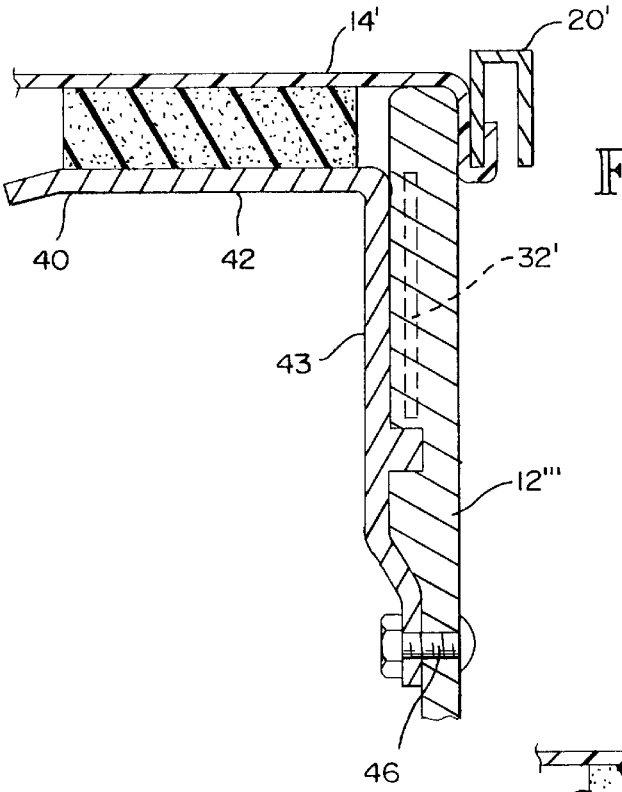
FIG. 9
FIG. 10
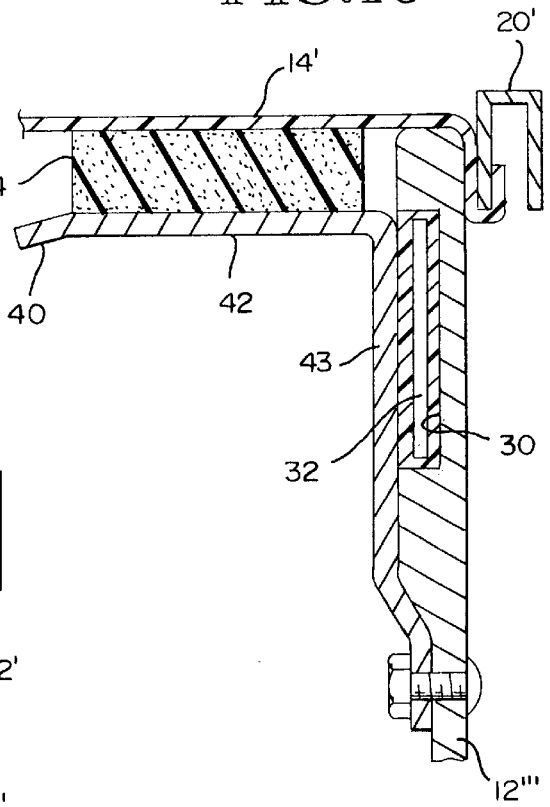
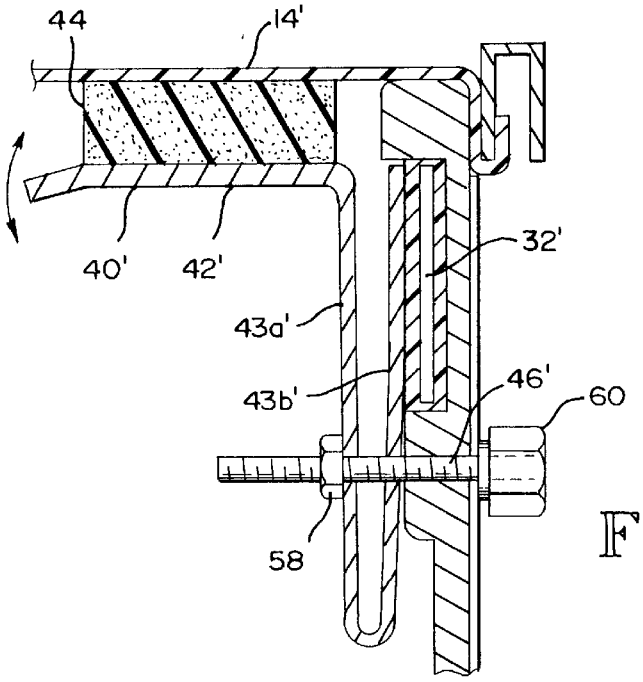
FIG. 11

ACOUSTIC DRUM WITH SHELL WALL EMBEDDED ELECTRONIC TRIGGER SENSOR AND HEAD TO SHELL SOUND TRANSFER ARM

CROSS REFERENCE TO RELATED APPLICATIONS

This is a continuation-in-part application of copending application Ser. No. 08/925,414 filed by the inventor herein on Sep. 8, 1997 for ACOUSTIC DRUM WITH ELECTRONIC TRIGGER SENSOR.

FIELD OF THE INVENTION

The invention relates to percussion musical instruments and in particular to a new acoustic drum with a sensor embedded in the drum shell capable of triggering an electronic device.

BACKGROUND OF INVENTION

Following the success of electric keyboards and guitars, innovators have created the electronic counterparts of other acoustic instruments, including drums.

In providing the electronic counterpart of acoustical drums, small circular resilient pads are often used to convert the strike of the player's drumsticks into electronic impulses that are in turn converted into synthesized, drumlike sounds. These electronic drum pads represent one kind of electronic percussion instrument for creating the synthesized drum sounds. Drum pads are typically made with stretched skin backed by a light density foam material over a transducer soundboard. An example of the electronic drum pad is found in U.S. Pat. No. 4,947,725. While electronic pads of this kind have enjoyed a following among musicians and audio engineers, the pads have not been able to provide the same feel and texture as the drum heads of the acoustic snare, tom and bass.

While electronic percussion instruments have the advantage of controlled output and the ability to produce a wide variety of sounds, they do not play the same as an acoustic drum. There is a definite disadvantage to the drummer in that the look, feel, and response of most electronic drums fail to give the player anything remotely similar to the response rhythm that a traditional acoustic drum provides. Since drummers acquire their technical ability from acoustic drums, the changeover to electronic pads may be unacceptable to some performers and less than optimum for others. The disadvantages are primarily in the feel of the sticks as they strike the simulated drum surface and in the drummer's motor memory in reaching for the usual placement and strike area of conventional acoustic sets.

In order to try and solve the problems associated with the feel of electric drums innovators have tried to use acoustic drums in place of the electronic pads as the triggering mechanism for a drum synthesizer. Generally, these devices use a transducer mounted on the acoustic drum in order to detect the impact of the drumstick on the drum head. There are three basic methods for mounting transducers on acoustic drums: air coupling including internal mounting, head mounting, and shell mounting.

Air coupling uses a transducer, typically a microphone, placed in close proximity to the drum head to detect air movement produced by the vibrating drum head. Because the transducer cannot readily discriminate the source of the air vibration, external air coupling is highly susceptible to background noise and produces a high percentage of false triggers. While internal mounting of the microphone within the internal cavity of the drum shell reduces the instances of false triggers it requires extensive modification to the drum and significantly alters the acoustic properties of the drum. Even in drums which use internal mounting for air coupling, there is a high incidence of false triggering. Another disadvantage to air coupling is that attached transducers tend to be mechanically unreliable and typically require a separate power source.

Head mounting uses a transducer, typically a piezoelectric element, glued or taped to the drum head to directly detect the vibration of the drum head. This method of mounting a transducer also suffers from a high incidence of false triggering because of the long duration for which the drum head continues to vibrate after it is initially struck. An acoustic drum head will vibrate much longer after it is struck than the pads typically used in electronic drums. Another disadvantage is that the acoustics of the drum are corrupted by mounting a transducer on the drum head. Additionally, head mounted transducers are inherently unreliable because the adhesives used are often unable to withstand the constant vibration of the drum head and eventually fall off.

Shell surface mounting uses a transducer, typically a piezoelectric element, screwed or glued to the inside or outside wall surface of the drum shell. While mechanically more reliable than air coupling or head mounting, shell surface mounting still suffers from an inability of the transducer sensor to discriminate between individual drumstick strikes on the drum head and background noise. Depending upon how and where the transducer is mounted, this method may also result in a degradation of the acoustic properties of the drum.

All three of these mounting methods share the disadvantages of being susceptible to false triggering, varying degrees of mechanical unreliability, and possible corruption of the acoustic characteristics of the drum. The most significant of these shortcomings is the problem of false triggering from background noise or retriggering caused by the long duration of the drum head vibration caused by a drumstick strike. This problem is typically overcome by setting the sensitivity threshold level where only the hardest strikes are registered by the drum synthesizer. While this may reduce the number of false triggers and retriggers, it severely limits the range of drumstick strikes which the synthesizer will register. This in turn will require the drummer to increase the force with which they strike the head in order to guarantee the strike registering.

Alternatively the drum may be dampened in order to increase the range of strikes the synthesizer will register, but this method effectively eliminates the acoustic functionality of the drum. An example of a dampened drum with an electronic sensor is found in U.S. Pat. No. 5,293,000.

SUMMARY OF THE INVENTION

There is demand for a drum that may be used as either an electric or acoustic instrument with the ability to change function on demand. There is a further demand for a fully functional acoustic drum with the ability to simultaneously trigger an electronic sound source without false triggering. There is still a further demand for an acoustic drum with the ability to simultaneously trigger an electronic sound source which does not require batteries or a phantom power source to make the drum work.

In accordance with the preferred embodiment of the invention described in parent application Ser. No. 08/925,414, a fully functional acoustic drum with the ability to simultaneously trigger an electronic sound source while remaining highly resistant to false triggering is provided by the combination of a drum body shell having an opening for receiving thereacross a drum head, preferably under tension, and forming therewithin a drum cavity and a sensor embedded in the wall of the drum shell. The opening in which the sensor is held is typically a recess formed by routing from the interior or exterior surface of the drum shell to provide a unique location in which a sound-to-electrical trigger transducer, i.e. sensor, is secured by a mix of epoxy and silicon or other suitable hardening adhesive. The location and configuration of the recess may vary depending on the dimensions of the drum, the drum shell material, and the type of sound-to-electrical trigger transducer being employed. The transducer is selected and the recess is sized and located such that when the transducer is mounted only a direct striking of the drum head or shell will produce a triggering electrical signal. The recess and transducer mounted therein are sized and placed such that the transducer will not produce a triggering electrical signal in response to ambient background noise.

The performance of the shell embedded transducer is further enhanced in accordance with the present invention by the addition of an energy transfer arm mounted inside the drum to couple sound vibration between the striking head and an, area of the shell overlying or proximate the embedded transducer. The arm may be of a rigid material such as a light weight metal or plastic and is preferably acoustically coupled to the underside of the striking head by an elastomeric pad. The arm acts to feel vibration of the head, without noticeable dampening, and to conduct vibration energy efficiently to the region near the transducer to blend with and augment the sound energy reaching the transducer through the shell and hardening adhesive. The arm is generally L shaped with a first leg portion fitted with the elastomeric pad sized to provide limited surface area contact with the head and is positioned adjacent the head perimeter. A second leg portion of the arm is held by a fastener anchored to the shell wall at a location separated from the head along the axial dimension of the shell by the placement of the embedded transducer so that the second leg portion passes from the head along the wall and over the recessed transducer to the fastener.

Another embodiment of the arm mounting has an adjustable fastener installed so as to be accessible from the exterior of the drum and allows the arm and pad to be moved toward and away from the head for selective head contact pressure and if desired temporary disablement.

Still another form of the arm mounting locates the second leg on the shell wall so as to be proximate but circumferentially and/or axially offset to the embedded transducer.

Further embodiments of the arm mounting include a contoured second leg portion that mates to a similarly contoured inside shell wall surface such as found on those drums having re-enforcement hoop construction; and an embodiment formed with a projecting stud or lug on the second leg portion facing the shell interior wall and shaped and sized to fit into a conforming hole in the shell wall overlying the recessed transducer or proximate thereto so as to provide additional coupling structure to transfer sound energy into the mounting area of the embedded transducer; and an embodiment having hi-performance, double-stick adhesive strip of flexible tape material interposed the surface of the second leg portion and the inside shell wall at or near the recessed transducer for added stability and sound energy coupling of the arm to the shell.

The components and operation of the inventive drum provide an easily manufactured, readily repairable, reliable musical system that combines the advantage of having an acoustic drum with the ability of being able to control an electronic sound source. The invention is applicable to standard types and sizes of drums, including snare, bass and tom, as well as custom sizes.

These and further features, objects and advantages of the invention will become apparent to those skilled in the art from the following detailed description and dependent drawings.

BRIEF DESCRIPTION OF THE DRAWINGS

FIG. 7 is a view similar to FIG. 6 showing an alternative embodiment of the structure for holding and adjusting the sound energy transfer arm relative to the drum head and shell;

FIG. 8 is a side view fragment looking at the interior wall of the drum shell and a cross-hatched section of the striking head with the sound transfer arm mounted in an alternative position relative to the transducer embedded in the shell wall;

FIG. 9 is a view similar to FIG. 6 showing an alternative configuration of the energy transfer arm;

FIG. 10 is a view similar to FIG. 6 showing still another version of the mounting of the energy transfer arm; and FIG. 11 is a view similar to FIG. 6 showing a form of the invention that allows adjustment of the sound transfer arm.

DETAILED DESCRIPTION OF THE INVENTION

Figure 1:
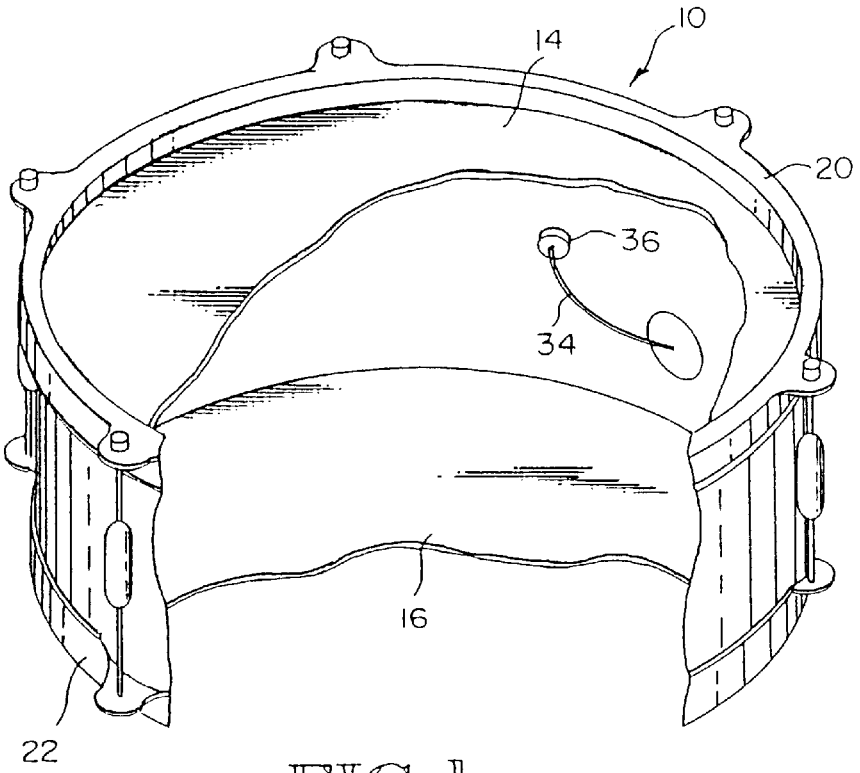
FIG. 1 is a cutaway perspective view of one embodiment of the present invention showing the external appearance of a tom drum body, the striking head of a tom drum and the internal placement of the sound-to-electrical trigger transducer.

In accordance with the invention disclosed and claimed in copending U.S patent application Ser. No. 08/925,414 a snare or tom drum is implemented as shown in FIGS. 1–4 to have the external appearance of a conventional acoustic drum 10 but incorporating within the drum shell 12 a recess 30 into which is embedded a sound-to-electrical trigger transducer 32. Typically, a piezoelectric element is used for trigger transducer 32 which is uniquely arranged to selectively, electronically sense direct striking of the drum head or shell while remaining electronically quiet without false triggering in the presence of other sources of sound energy and sympathetic vibrations. The system is resistant to triggering when stand and other accessories are inadvertently lightly hit. The drum should and does trigger when struck on the rim 20 and 22, shell 12 or lugs 28. The sound energy attenuating characteristics of the hardening adhesive material and the surrounding shell wall prevent the transducer from being falsely triggered by ambient sound exterior to the drum, by sympathetic vibrations of the drum, and resists false triggering due to lightly, inadvertently hitting the drum stand.

Figure 3:
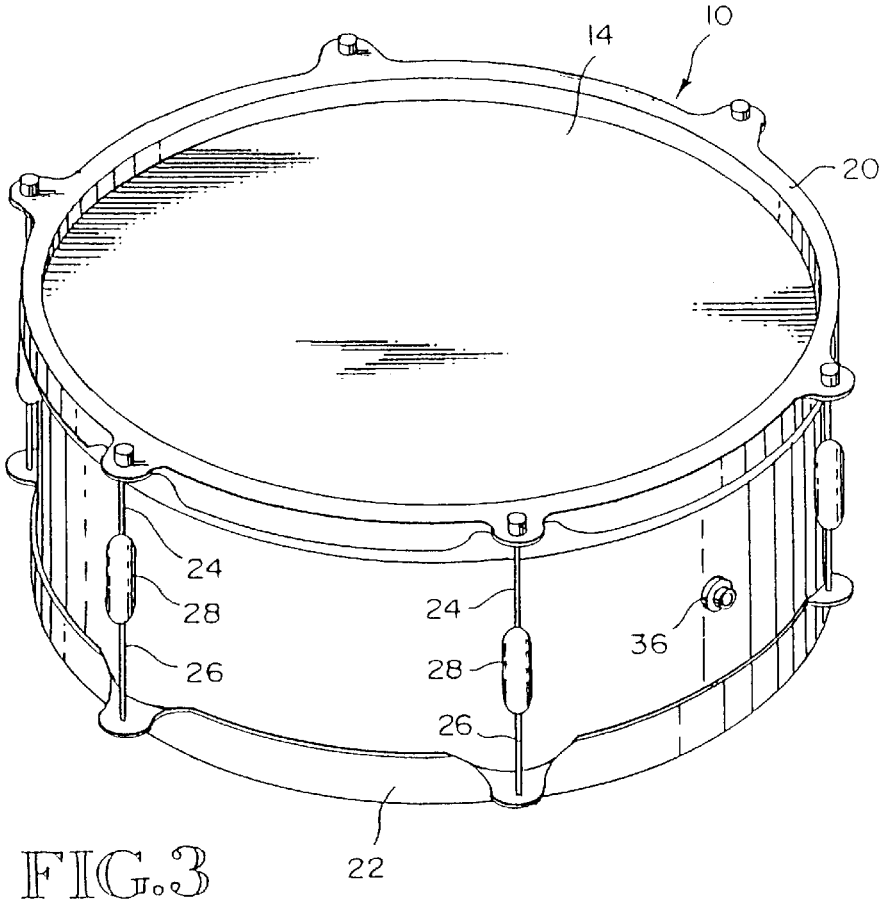
FIG. 3 is a perspective view of one embodiment of the present invention showing the external appearance of a tom drum body and striking head of a tom drum.
Figure 4:
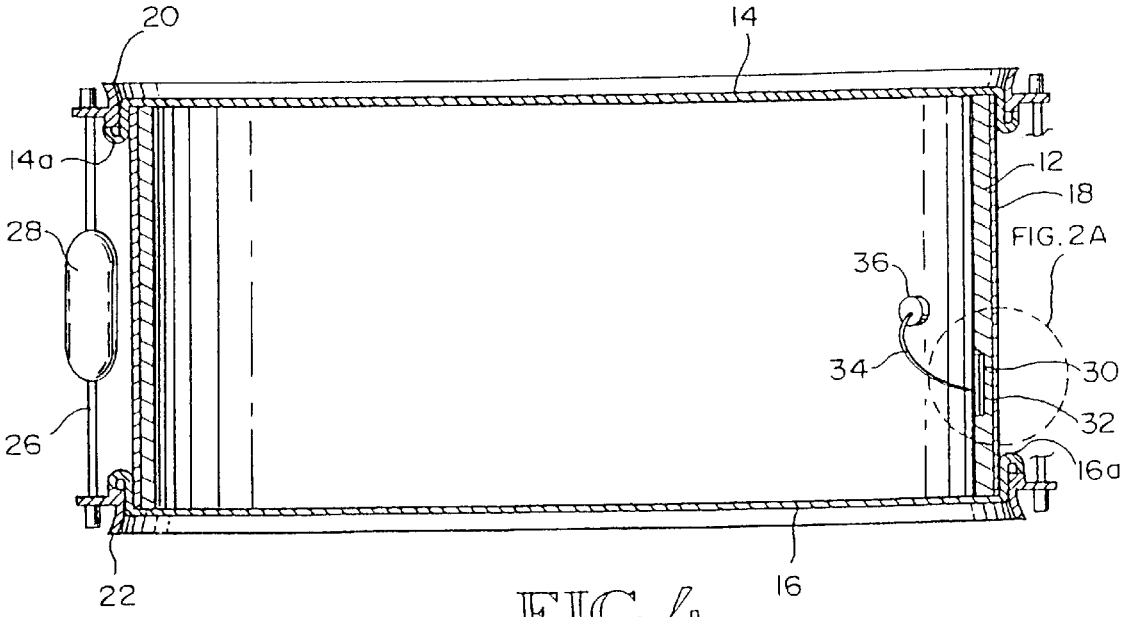
FIG. 4 is a vertical section through the diameter of the tom drum illustrated in FIG. 3.
Figure 5:
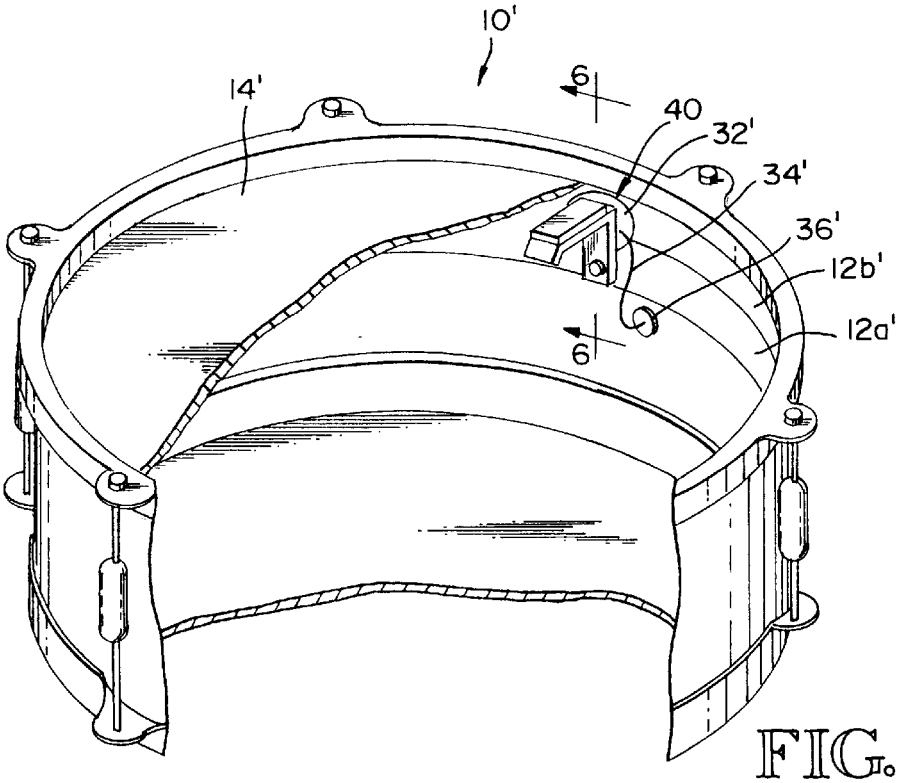
FIG. 5 is an isometric view partly cut away to show the sound transmitting arm of the present invention for coupling sound energy from the striking head to the area of the shell embedded transducer.
Figure 6:
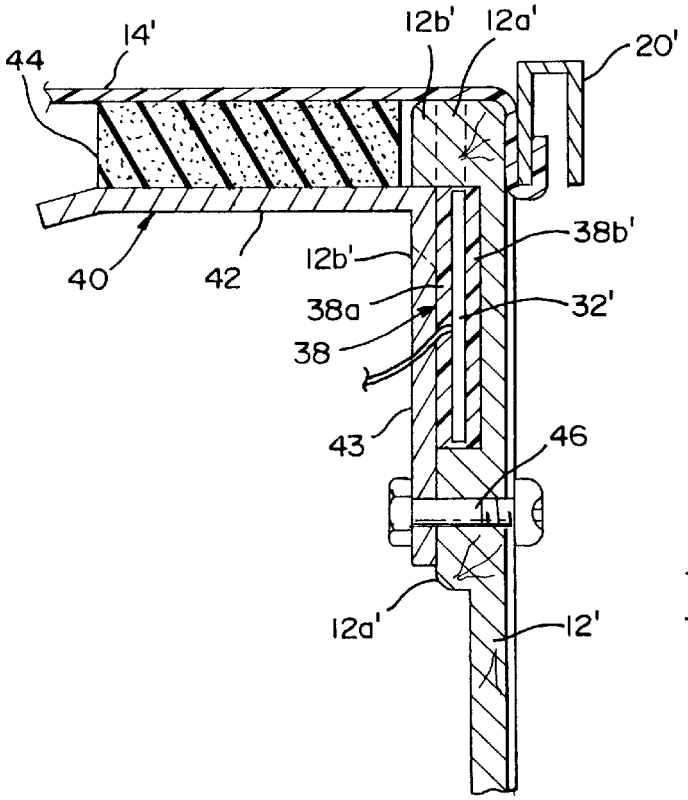
FIG. 6 is an axial section through cutting plane 2—2 of FIG. 6.

The snare, bass, and tom configurations are essentially the same and are represented by the internal construction of tom drum 10 shown in FIGS. 1–4 and described as follows. The drum frame or body is a hollow, wooden cylindrical shell 12, to which a striking drum head 14 and an opposed lower drum head 16 are disposed across the open axial ends of the cylindrical shell 12. A decorative, relatively thin plastic or other material wrap 18 may be provided about the outer circumferential wall of shell 12. To further absorb and/or dissipate sound energy that otherwise might cause false triggering, the body shell 12 is a 6-ply, veneer hardwood which has proven to work better than metal or plastic shells. Shells constructed from maple, birch or mahogany are preferred and may have a variable number of ply (5–10 ply is typical). As shown in FIGS. 3 and 4, and the entire assembly is held in place by conventional head hoops or rims 20 and 22 and circumferentially spaced pairs of inline tensioning screws 26 and cooperating retaining lugs 28. The striking head 14 and bottom head 16 each have a circumferential edge bead 14*a* and 16*a*, respectively, which is engaged by a shoulder of tensioning rims 20 and 22, respectively, to stretch heads 14 and 16 across the axial end openings of shell 12 to a desired tension control by adjusting screws 24 and 26 in the same manner as an acoustical drum is tuned. The drum heads 14 and 16 are conventional acoustic heads of synthetic flexible sheet material or animal skins.

Unlike a traditional acoustical drum, refer to FIGS. 1 and 4, the interior cavity formed by the inner circumferential wall of shell 12 and the spaced parallel inner surfaces of striking head 14 and bottom head 16 is provided with a recess 30 into which is embedded a sound-to-electrical trigger transducer 32. In the preferred embodiment the recess 30 is formed by routing out an open space having a diameter larger than the selected sound-to-electrical trigger transducer 32. The depth of the recess is dependent upon the dimensions of the drum, the shell material, and the type of transducer being used.

The transducer 32 itself is a piezoelectric assembly and consists of a piezoelectric element mounted on a somewhat larger diameter metal disk and having leads 34*a* and 34*b* soldered or brazed to the transducer components. More particularly, the piezoelectric transducer used in this embodiment has the following manufacturer specifications: element thickness 0.53 mm; metal thickness 0.25 mm; electrode diameter 23.5 mm; impedance 200 ohms; and frequency 2.8 kHz–0.5 kHz. Other commercially available sensors, including various piezoelectric transducers, may be used for the sound-to-electrical trigger transducer 32. Extending from transducer 32, leads 34*a* and 34*b*, which may be individual wires or a section of coaxial cable, connect to the terminals of a standard ¼" audio jack assembly 36 mounted on shell 12 and passing through the shell 12 and the plastic cosmetic wrap 18 as illustrated in FIG. 4.

Figure 2A:
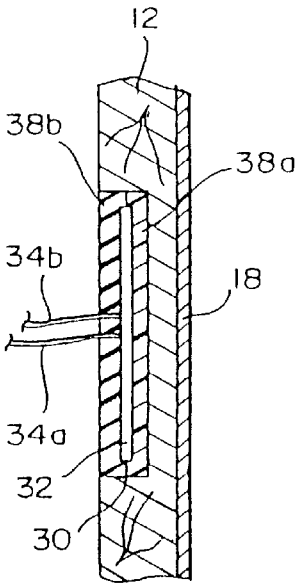
FIG. 2*a* is an enlarged sectional view illustrating the sound-to-electrical trigger transducer mounted within a recess in the drum shell sandwiched between two layers of hardening adhesive material.
Figure 2B:
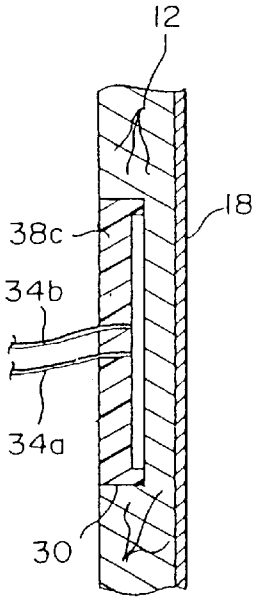
FIG. 2*b* is an enlarged sectional view illustrating the sound-to-electrical trigger transducer mounted within a recess in the drum shell with a layer of hardening adhesive material deposited on top of the sound-to-electrical trigger transducer.

To mount transducer 32 within recess 30, refer to FIGS. 2A and 2B, it is preferred that a hardening adhesive material 38 be used to permanently mount the transducer 32 within recess 30. In the preferred embodiment, the hardening adhesive material 38 is comprised of silicone and epoxy resin. Other commercially available mounting materials may be used.

FIG. 2A illustrates the preferred mounting method, wherein the transducer 32 is sandwiched between two layers of hardening adhesive material 38*a* and 38*b* within recess 30. In the preferred embodiment, hardening adhesive material 38*a* is an epoxy resin which is first deposited into the recess 30. Then the transducer 32 is mounted in the epoxy layer of hardening adhesive material 38*a*. A second layer of hardening adhesive material 38*b* is then deposited on top of the transducer 32 so as to fill the remaining volume of the open space or recess 30. In the preferred embodiment the second layer of hardening adhesive material 38*b* is silicone.

FIG. 2B shows an alternative mounting method wherein the transducer is placed within the recess and then a single layer of hardening adhesive material 38*c* is deposited over the top of the transducer 32 thereby filling the remaining volume of recess 30. In this embodiment, the hardening adhesive material 38*c* is either silicone, epoxy resin, or a combination of the two materials.

FIGS. 1–4 illustrate a recess that has been formed from the interior surface of the drum shell 12. However, it is well within the scope of the invention to include open spaces that have been formed from the exterior surface of the drum shell 12. In the case where the open space or recess 30 is formed from the exterior of the drum shell surface the electrical leads 34*a* and 34*b* may either be passed through an opening in the shell wall surface to the interior cavity in order to be connected to audio jack assembly 36. Alternatively, electrical leads 34*a* and 34*b* may pass along the surface of drum shell 12 to be connected to audio jack assembly 36. Outer wrap 18 may be used to both protect and cover leads 34*a* and 34*b*.

From jack 36, the electrical signals produced by transducer 32 in response to striking drum head 14 are fed to conventional downstream electronics.

In this continuation-in-part application, the present invention provides a drum 10' constructed with a sound energy transfer arm 40 mounted to extend between the drum head 14' and drum body shell 12' with a portion of the arm passing proximate to the shell wall embedded sound-to-electrical trigger transducer 32'. In the preferred embodiment, the transducer 32' is disposed in the shell 12' at a location proximate the striking head 14' closing one open end, and, more particularly, the transducer is embedded in a recess 30' formed by routing from the interior of the shell in a thickened wall hoop reinforcement rim area of a first reinforcement hoop 12*a*' of axial depth extending from the rim down to a terminus below the fastener 46 and a second reinforcement hoop 12*b*' of relatively smaller axial depth and located adjacent the rim and extending to about mid-height of the transducer 32'.

The transducer 32' is, as above, secured with an adhesive hardening material applied at 38*a*' and 38*b*' so as to cover both faces of the disk-shaped transducer and thus embed it in the wall recess 30. As above, electrical leads 34' extend from the transducer to a jack 36' accessible from the drum shell exterior.

The energy transfer arm 40 is preferably generally an inverted L-shape with an upper horizontal leg portion 42 with a head contacting outward face covered by an acoustically transmissive pad 44 of elastomeric compliant material such as an open cell medium weight foam such as neoprene. A second and downwardly extending vertical leg portion 43 of the arm is anchored to the shell 12 so that an outward face of the leg lies is intimate contact with the shell interior wall overlying the embedded transducer 32'. The wall area surrounding transducer recess 30 is preferably grooved to match the width and length of arm leg portion 43 so as to be disposed in intimate contact with the hardening adhesive 38*a* that covers the transducer 32'. A bolt shank or other fastener 46 passes through the shell wall beneath the embedded transducer, thus on the remote extent thereof from the striking head 14', and through a hole in leg portion 43 and a nut tightens against the arm leg to hold the assembly fast to the shell wall while allowing the upward extent of the arm to transfer head vibration energy down to the location of the sensor. The arm 40 is mounted so that pad 44 on the upper leg just contacts with slight pressure, the underside of the striking head picking up vibration and energizing the arm body without noticeable dampening of the head, and conducting vibration energy efficiently to the shell region near the transducer to blend with, and augment, the sound energy reaching the transducer through the shell and hardening adhesive.

The length of the lower leg portion 43 that presses against the shell, the head contact area at the pad 44 on upper leg portion 42, and the thickness of arm pad 44 are selected relative to the size, diameter, axial depth of the drum and the tuned tightness of the drum head. Larger drums generally will have greater contact area and the pad thickness. These parameters are chosen for desired filtering, limited dampening, triggering sensitivity and tracking. As an example, for a drum of DA=14 inches diameter, DP=7 inches depth and typical tuning, a suitable arm pad has a thickness of about T=¼ inch, a pad contact area A=0.5 inches formed by an L=2.5 inches by W=0.5 inches in a generally rectangular shape, elongated along the radial dimension of the head and relatively narrower width in the circumferential dimension, so that the arm and pad couple sound energy but do not cause excessive dampening of the striking head. More particularly, the arm to head contact pad 44 should preferably have a limited contact area ratio to the striking head area of about 1:300 and should not project inward from the rim by more than ½ of the head radius of R so that the head is substantially free to vibrate with the usual modal resonance of a standard acoustic drum. Note that this functional aspect of the energy transfer arm which allows energy channeling without appreciable dampening is fundamentally different from the head muffler or dampener known per se in prior art drums where the muffler is pressed against the head so as to substantially arrest the modal vibration. The lower leg portion 43 of the arm 40 may have a different shape but for manufacturing efficiency the arm is made by a stock metal or plastic of several inches long by about ⅛ inch thick and about ½ inch wide bent or cut from an angle stock to produce the inverted L shape with the leg portion 42 of about 2.5 inches long and leg portion 43 of about 1.25 inches long and an elastomeric pad 44 of ⅛ to ⅝inches thick. More generally, energy transfer arm 40 is suitable for drums of DA between 8 and 18 inches, DP of 3.5 to 18 inches and with an arm contact area to drum head area ratio of 1:500 to 1:150.

In FIG. 7, an alternative mounting of arm 40 is illustrated in which an adjustable fastening structure is provided for adjusting the transmission arm contact with head 14'. At the location of fastener shank 46, an axial extending slot 50 is formed in the shell wall to allow the arm assembly to be adjusted axially by loosening a wing nut 52 on the a protruding threaded end of the shank at the exterior of the shell wall and cover and then sliding the arm toward or away from head 14' and then retightening nut 52. This allows the contact pressure at pad 44 to be adjusted for optimum response sensitivity and minimum head dampening. Also, the adjustment mechanism allows the arm to be disabled by withdrawing it from contact with the drum head is desired.

In FIG. 8, a still further alternative embodiment is shown in combination with the adjustable mechanism of FIG. 7 in which the leg portion 43 is located to be proximate but circumferentially offset as indicated at 54 from the embedded transducer 32'. In such case the sound energy is transferred through the arm to an area of the shell wall in the proximity of the transducer mounting and thus couples energy from the head to the transducer through the intervening shell body. This alternative construction reduces the amount of energy coupling but is adequate for some applications and can be used with or without the arm adjustment feature of FIG.7.

In FIG. 9, another alternative embodiment of arm 40 is shown which has a sound conducting protrusion 56 on the outside face of leg portion 43 and is fitted into a mating shallow hole in the interior wall of shell 12" proximate the recessed transducer 32'. Such protrusion 56 in intimate engagement with the shell enhances the sound energy transfer proximate the embedded sensor and will improve the trigger sensitivity if desired.

In FIG. 10, another embodiment is shown that has a contoured second leg portion on arm 40' matched to the changing thickness of the shell wall at transitions along the axis due to variable thickness of the shell near the rim. Such variable interior wall dimension may be due to the construction of reinforcement hoops as described above or simply the shaping of the shell with a thickened rim region during manufacture.

In FIG. 11, an alternative embodiment having the adjustable arm is depicted in which the equivalent of the second leg portion of the arm is V shaped and made of spring metal with a leg section 43*a*' connected at its upper end to and supporting the horizontal pad carrying leg 42' and connected at its lower end to leg section 43*b*' which is the other half of the V. Leg section 43*b*' has its outside face pressed against the shell over the embedded transducer as shown and the assembly is held in place by a threaded shank 46' threaded into a collar 58 on leg section 43*a*' and passing freely through a hole in leg section 43*b*'. The end of shank 46' that passes through the shell wall to the exterior of the drum has a manual knob 60 attached thereto. By rotating the knob to adjust the position of shank 46' relative to threaded collar 58, the spring V is opened to swing leg portion 42' like a hinge about the V-joint pulling pad 44 away from the striking head 14', or closed to swing leg portion 42' toward the head to press the pad into sensing contact therewith.

While only particular embodiments have been disclosed herein, it will be readily apparent to persons skilled in the art that numerous changes and modifications can be made thereto, including the use of equivalent means, devices and methods, without departing from the spirit of the invention.

I claim:

1. A percussion instrument comprising:

a) a drum shell having a wall defining an interior surface and an exterior surface and at least one open end;

b) a striking drum head mounted across the one open end of said shell;

c) a sound-to-electrical trigger transducer mounted in said shell; and d) a vibration transfer arm mounted to extend between said drum head and said drum body shell proximate said sound-to-electrical trigger transducer.

2. The percussion instrument of claim 1, wherein said sound-to electrical transducer is disposed in said shell at a location proximate the one open end.

3. The percussion instrument of claim 2, wherein said sound-to-electrical transducer is disposed in an open space formed in said drum shell and secured with an adhesive material; and said arm has a head contacting portion and an anchored portion, said anchored portion being attached to said shell proximate said open space.

4. The percussion instrument of claim 3, wherein said open space is a recess formed in the interior surface of said drum body shell.

5. The percussion instrument of claim 2, wherein said drum shell is comprised of multiple ply and said sound-to-electrical transducer is embedded in a recess that is formed in at least one of the multiple ply.

6. The percussion instrument of claim 1, wherein said vibration transfer arm is generally L-shaped and has a first leg that is mounted to said shell and a second leg disposed to contact said head.

7. The percussion instrument of claim 1, wherein said vibration transfer arm has a head contact portion formed with an elastomeric pad.

8. The percussion instrument of claim 1, wherein said vibration transfer arm is disposed inside said shell adjacent said interior surface.

9. The percussion instrument of claim 1, wherein said vibration transfer arm has a portion attached to said shell at a location at least partly overlying said transducer in said shell wall.

10. The percussion instrument of claim 1, wherein said vibration transfer arm is releasably attached to said shell by a manual fastener.

11. The percussion instrument of claim 10, further comprising adjustable structure for adjusting the transmission arm contact with said head.

12. The percussion instrument of claim 1, wherein said sound transmission arm is located inside said shell and further comprising mechanism for adjustably positioning said arm relative to said head, said mechanism accessible from outside said shell.

13. The percussion instrument of claim 12, where in said mechanism includes a structural portion that passes through an axially elongated slot in said shell wall and a manually operable part accessible on the exterior of said shell for adjustably sliding the sound transmission arm axially of the shell wall and tightening device for tightening said mechanism to secure the sound transmission arm in an anchored position relative to said shell and head.

14. A percussion instrument comprising:

a) a hollow cylindrical drum shell having an interior wall surface, an exterior wall surface, an axial open end and a second axial end;

b) a recess formed in said shell between the axial ends;

c) a mechanical to electrical transducer mounted in said recess;

d) a striking drum head mounted across the axial open end; and d) a sound transmission arm mounted inside said shell adjacent said interior wall so as to contact said striking head and said interior wall proximate said transducer.

15. The percussion instrument of claim 14, wherein said arm has a first portion that extends from a location proximate said shell at the axial open end diametrically inwardly of said striking drum head for a distance of no greater than ½ of the head radius and a ratio of arm to head contact area in the range of 1:500 to 1:150 so as to have minimal dampening of the head vibration.

16. The percussion instrument of claim 15, wherein said arm has an elastomeric pad on said first portion contacting said head and coupling sound energy between said head and arm.

17. The percussion instrument of claim 15, wherein said arm has a second portion that depends downward from the axial open end and striking drum head along the interior wall surface of said shell in overlaying relation to said recess and transducer disposed in said recess.

18. The percussion instrument of claim 17, a fastener holding said second portion of said arm to said wall of said shell.

19. The percussion instrument of claim 17, wherein said fastener has a shank portion passing through said shell wall to anchor said second portion of said arm at a location on the remote side of said transducer from said striking head.

* * * * *